US006672045B2

(12) United States Patent
Heaney et al.

(10) Patent No.: US 6,672,045 B2
(45) Date of Patent: Jan. 6, 2004

(54) APPARATUS AND METHOD FOR SPLICING THREADLINES BY KNOT-INDUCED THREAD TWIST ENTANGLEMENT

(75) Inventors: Patrick J. Heaney, Neenah, WI (US); David R. Roland, Winneconne, WI (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 94 days.

(21) Appl. No.: 10/100,943

(22) Filed: Mar. 19, 2002

(65) Prior Publication Data

US 2002/0134067 A1 Sep. 26, 2002

Related U.S. Application Data

(60) Provisional application No. 60/278,145, filed on Mar. 23, 2001.

(51) Int. Cl.[7] ..... D01H 17/00

(52) U.S. Cl. ..... 57/22; 289/1.2; 289/1.5; 289/17

(58) Field of Search ..... 57/22, 23, 159, 57/6; 43/1, 4; 28/47, 209; 66/116, 117; 289/1.2, 1.5, 2, 17, 18.1; 223/102; 401/6; 606/139, 205, 228

(56) References Cited

U.S. PATENT DOCUMENTS

| | | | | | |
|---|---|---|---|---|---|
| 2,177,680 | A | | 10/1939 | Abbott | |
| 2,648,890 | A | * | 8/1953 | McDonald | 57/22 |
| 2,844,859 | A | | 7/1958 | Griset, Jr. | |
| 3,306,020 | A | * | 2/1967 | Rosenstein | 57/22 |
| 3,334,477 | A | * | 8/1967 | Morin et al. | 57/6 |
| 3,407,583 | A | | 10/1968 | Irwin et al. | |
| 3,668,852 | A | * | 6/1972 | Fusco et al. | 57/22 |
| 3,690,994 | A | * | 9/1972 | Williams | 156/433 |
| 3,732,678 | A | | 5/1973 | Berry, Jr. | |
| 3,923,588 | A | * | 12/1975 | Warthen | 156/359 |
| 4,002,012 | A | * | 1/1977 | Norris et al. | 57/22 |
| 4,019,700 | A | | 4/1977 | King | |
| 4,135,353 | A | | 1/1979 | Eisenberg | |
| 4,254,610 | A | | 3/1981 | Pierce et al. | |
| 4,651,938 | A | | 3/1987 | Memminger et al. | |
| 5,887,322 | A | * | 3/1999 | Hartzheim et al. | 28/209 |
| 5,971,447 | A | * | 10/1999 | Steck, III | 289/17 |

FOREIGN PATENT DOCUMENTS

| | | | | |
|---|---|---|---|---|
| DE | 2439361 B1 | | 8/1974 | |
| DE | 3336202 A1 | | 4/1985 | |
| EP | 0291484 A1 | | 11/1988 | |
| JP | 01176790 | | 7/1989 | |
| WO | WO 97/28079 | * | 8/1997 | B65H/69/06 |

* cited by examiner

*Primary Examiner*—Gary L. Welch

(57) ABSTRACT

This invention provides an apparatus and method for splicing together two threadlines in a manufacturing process and, more specifically, to a manually assisted apparatus and method resulting in a knot-induced twist entanglement splice that joins a threadline from a standby spool to the running threadline from an active spool.

4 Claims, 4 Drawing Sheets

APPARATUS AND METHOD FOR SPLICING THREADLINES BY KNOT-INDUCED THREAD TWIST ENTANGLEMENT

BACKGROUND OF THE INVENTION

1. Field of the Invention

This invention relates to an apparatus and method for splicing together two threadlines in a manufacturing process and, more specifically, to a manually assisted apparatus and method resulting in a knot-induced twist entanglement splice that joins a threadline from a standby spool to the running threadline from an active spool.

2. Description of Background Art

There are certain manufacturing processes that rely upon a steady supply of a threadline or multiple threadlines of fiber, yarn, or filament. All such threadlines, however, are shipped in discrete packages (also referred to as thread spools), and connecting the trailing end of one package to the leading end of the next package becomes necessary.

U.S. Pat. No. 3,668,852 discloses an apparatus for automatically wrapping a splicing filament around the yarns to be spliced. U.S. Pat. Nos. 3,923,588 and 3,690,994 describe devices for thermally splicing thermoplastic yarns. All of the devices disclosed above require that the moving threadline be stopped in order to perform the splicing manipulation.

Published PCT Application WO 97/28079 discloses pressing and fusing two yarns which are placed in a crossing position. This method avoids having to stop the advancing threadline, but a complex mechanical buffer system is required to do so.

German Published Patent Application No. 33 36 202 discloses a device for interlacing filament yarns with an air splicer without interrupting yarn transport. This process, however, is limited to uncoalesced, multifilament threadlines.

U.S. Pat. No. 5,887,322 discloses an apparatus and method for splicing two threadlines with adhesive tape applied by a pair of counter-rotating adhesive applicators. This device requires coordination of components including alignment assembles, adhesive applicators, cutting knives and the unwinder through the use of timers, solenoids, and stepper motors with adjustable timings.

There exists a need for a simple, versatile, and reliable apparatus and method for splicing a moving threadline to another threadline. There is such a need especially for fibers that exhibit stretch properties, such as spandex.

SUMMARY OF THE INVENTION

The invention provides a method and apparatus for splicing threadlines using a knot. The threadlines are preferably elastic fiber, yarn or filament.

In a first embodiment, the invention provides a method for splicing an elastic thread comprising the steps of:

a. feeding a first elastic thread in a line or path between two guides under tension;

b. positioning a second replacement elastic thread substantially parallel to said first thread;

c. slip-knotting said second replacement elastic thread to encircle said first elastic thread with a loop of said second elastic thread without gripping said first elastic thread;

d. tightening the loop of step (c) in said second replacement elastic thread to grip said first elastic thread and to draw said replacement elastic thread along the path of said first elastic thread;

e. releasing tension on said first elastic thread by cutting so that the second elastic thread runs between the thread guides of step (a).

The invention further comprises a splicer comprising:

a. a pair of thread guides for positioning a running thread under tension;

b. a third thread guide for holding at least a portion of a replacement thread substantially parallel to and in alignment with said running thread;

c. a longitudinally slotted cylindrical thread holder for positioning a slip-knotted loop of said replacement thread around said running thread such that said slip-knotted loop and said running thread are initially held apart, such that when the slip-knotted loop is manually slipped off the slotted cylindrical thread holder and makes contact with the replacement thread, the replacement thread is then drawn through said slotted cylindrical thread holder along the line defined by the first elastic thread.

The splicer of the invention may optionally include means for cutting the running thread.

DETAILED DESCRIPTION OF THE INVENTION

The apparatus and method of this invention is designed for use in manufacturing processes where the threadline is fed from a spool to such process by a rolling take-off unwinding device. Such devices operate by causing the threadline spool to rotate while simultaneously providing means for pulling the threadline off the spool. These unwinding devices are "draft controlled", meaning that the tension imposed on the threadline is maintained at some constant, pre-selected level. When an extensible fiber, such as spandex, is used, typically the elongation of the threadline is controlled.

It has been found that threadlines that are fed from a rolling take-off unwinding device, through a series of guides to a manufacturing process, experience local twisting, although no net twist is imparted. The apparatus and method of this invention for thread splicing utilize this localized twisting to induce entanglement, thereby facilitating a splice. A knot is used initially to hold the running and new threads in contact. As the threads continue to be fed, the threads twist together, entangling and forming a splice that maintains its integrity, even at threadline elongations at least as high as 300%. This twisting also entangles the transfer tails (meaning the excess lengths of thread that extend from the knot) and incorporates them into the splice, preventing any downstream disruptions in the thread path.

The apparatus of this invention is useful with commercially available elastic thread unwinders such as an AccraTec T series elastic thread unwinder (AccraTec Engineering, Neenah Wis.). Commercial elastic thread unwinders can be capable of supplying multiple threadlines to a manufacturing process. The apparatus of the invention adds splicing capabilities to an elastic thread unwinder. The apparatus of the invention includes i) a standby thread spool to accommodate a standby thread; at least one single thread idler to guide the threadline originating from the standby thread spool; ii) at least one multiple thread idler that allows convenient substitution, in the proper threadline position, of an active threadline by a standby threadline; iii) a means for supporting a standby spool in a non-rotating position above the spool drive rolls, lowering the standby spools to contact with the spool drive rolls, and for lifting a nearly exhausted active spool away from contact with the drive rolls to a non-rotating standby position; iv) a means for precise adjustment of the position of such lifting and lowering device to engage the selected spool; and v) and a series of slotted tie-tubes for forming the splice.

As used herein, "threadline" means any thread which is substantially continuous, such as monofilaments, spun staple yarns, continuous multifilaments, continuous coalesced multifilaments, and the like. Such fibers can be synthetic or natural.

Figure 1:
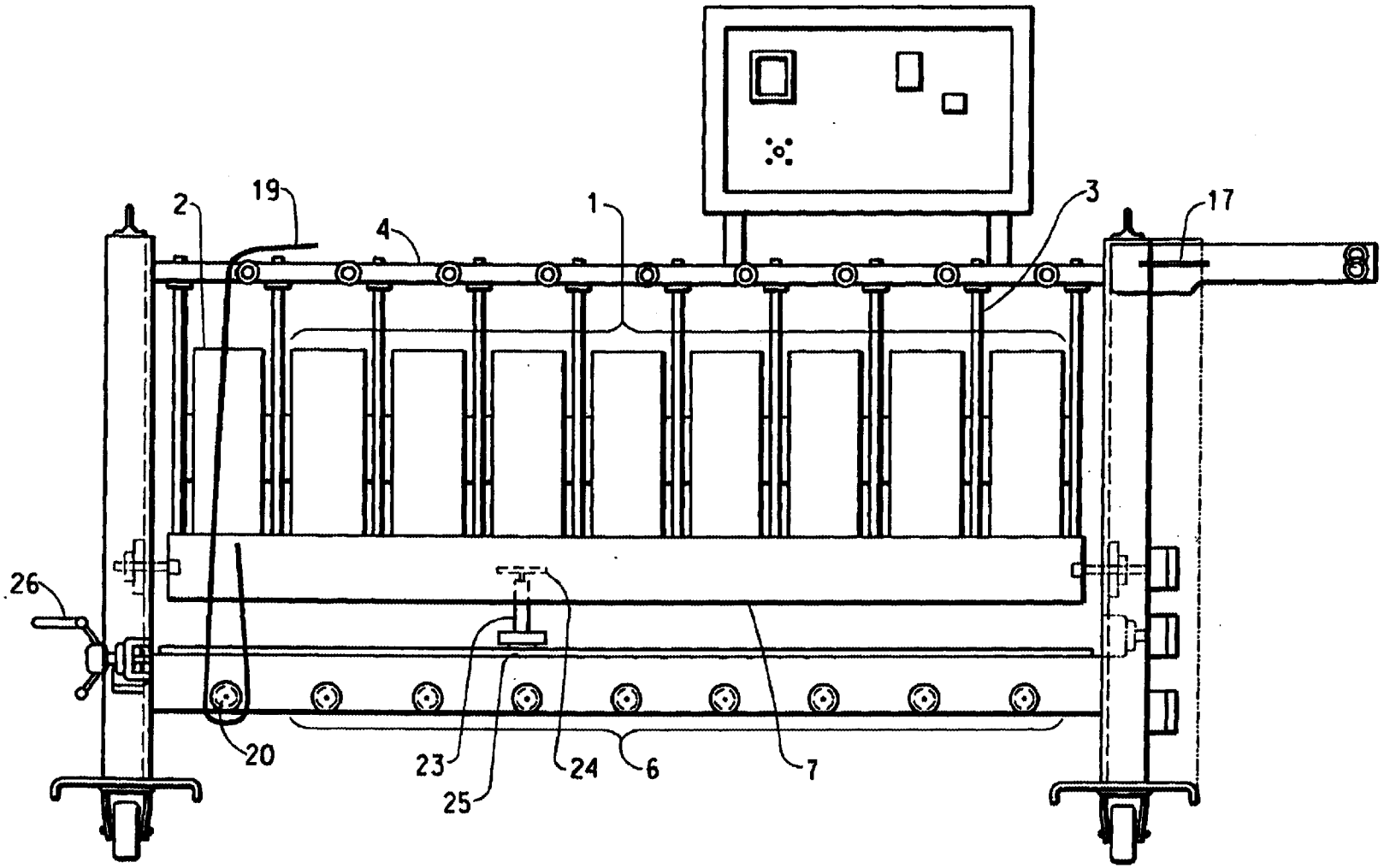
FIG. 1 is a front view of a multi-spool unwinder device incorporating the splicing apparatus of the present invention capable of accommodating eight active threadlines.
Figure 2:
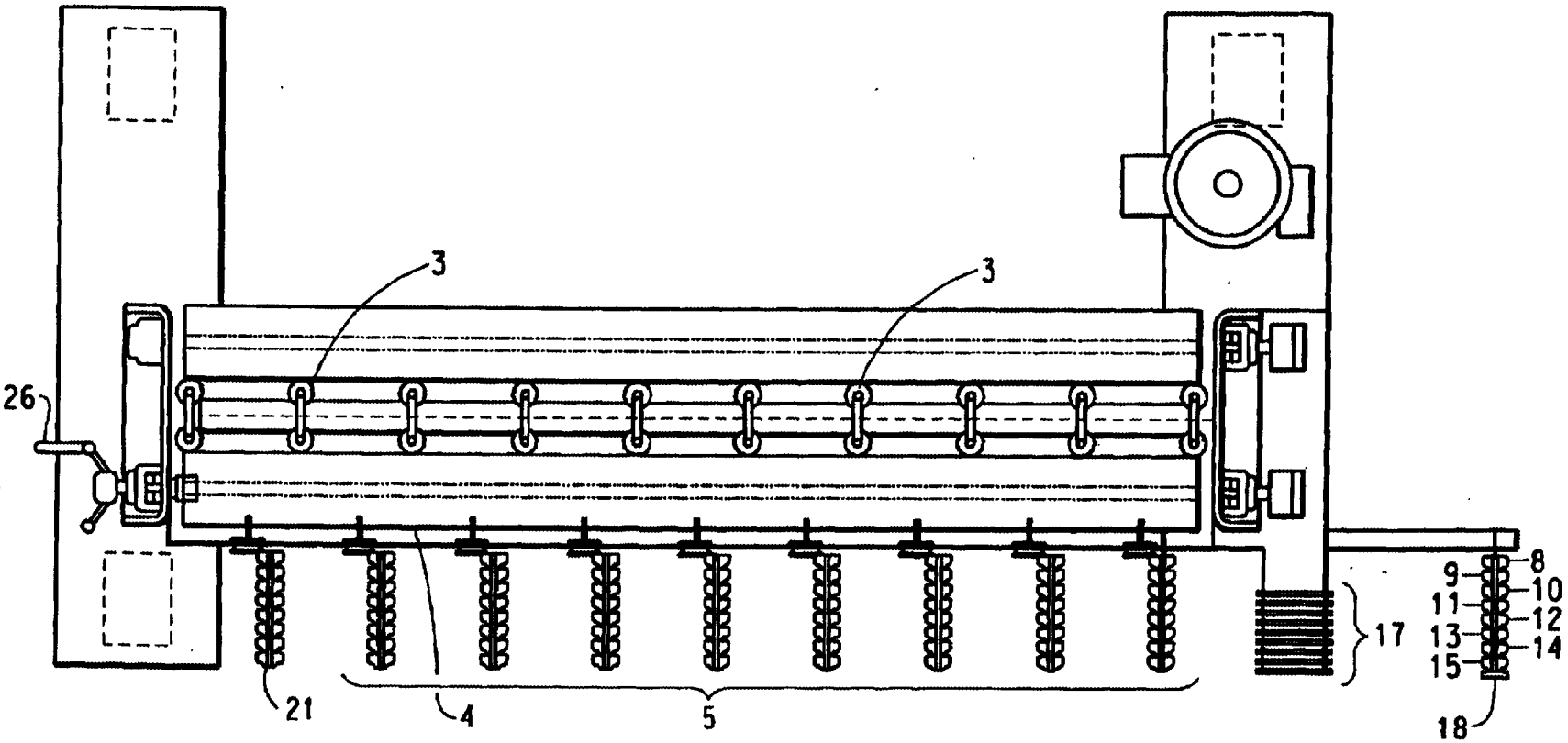
FIG. 2 is a top view of the unwinder and splicing device of FIG. 1.
Figure 3:
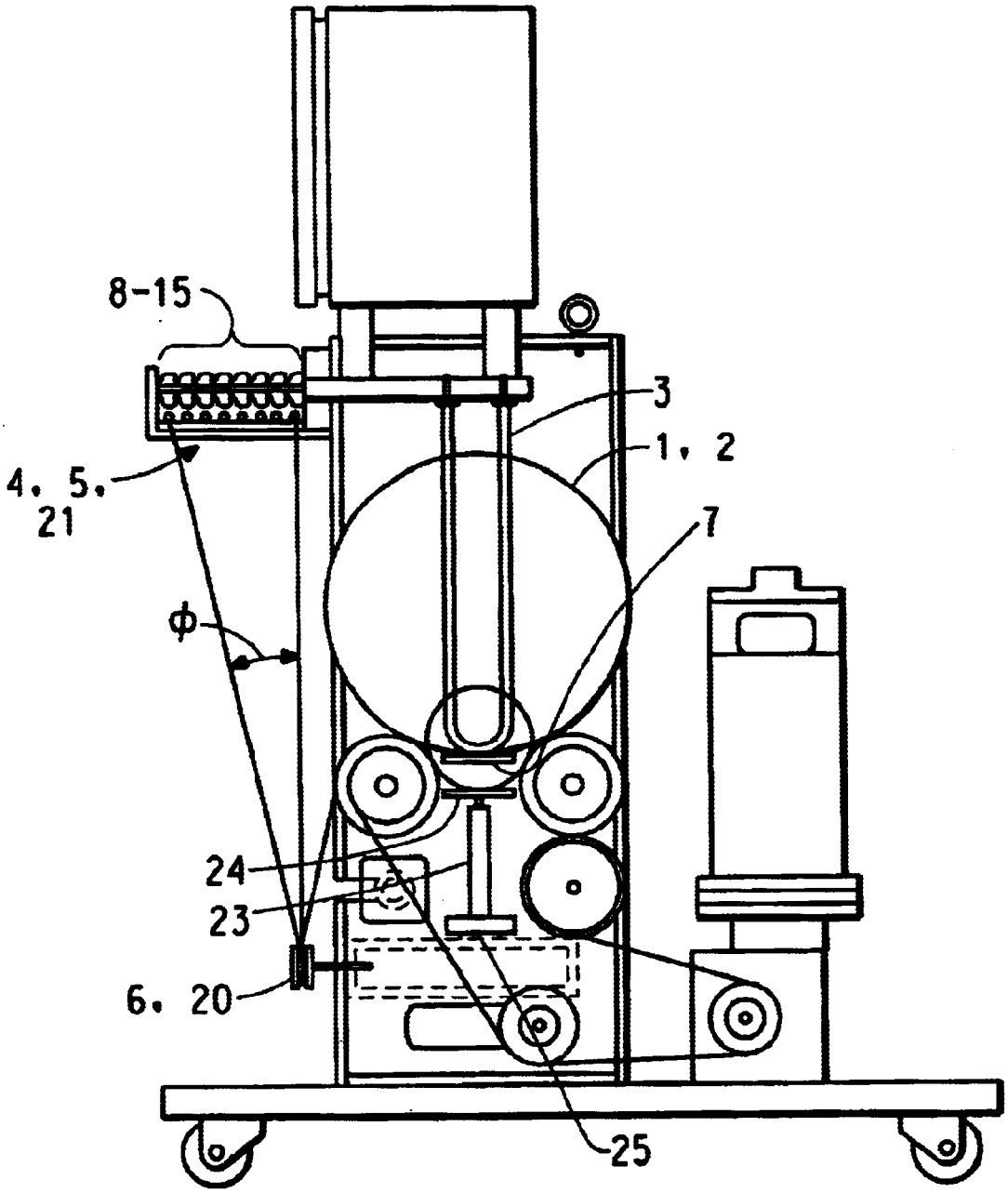
FIG. 3 is side view of the unwinder and splicing device of FIG. 1.

FIGS. 1–3 illustrate a multiple-spool unwinding and splicing device. This particular device is designed for supplying a manufacturing process that requires eight individual threadliness and, therefore has the capacity for nine spools, eight active spools 1 and one standby spool 2. Such thread unwinding devices can be configured with a single tier (as shown here) or multiple tiers of spool mounting racks. Either type of design is compatible with the instant invention. Vertical spool guide rods 3 are provided in order to maintain thread spool separation within each tier.

With reference to FIGS. 2 and 3, a multiple thread, ganged idler assembly 4 (an idler being defined as a roll that can freely rotate and is not driven) is positioned at a discrete distance above the active spool positions. The number of idlers comprising this ganged assembly corresponds to the total number of thread lines being fed to a manufacturing process. The vertical distance between the ganged idler assembly and the active spool positions is such that the maximum thread angle, $\Phi$, measured from vertical, between the single turning idler and the multiple thread idler when the thread occupies the outer-most position does not exceed about 20°. Equipment configurations that result in substantially larger angles may prevent the threadline from being firmly captured in its assigned threadline position on the idler. Each multiple thread idler 5 has the number of thread positions equal to the number of threads being fed to a manufacturing process. With reference to FIGS. 1 and 3, the threadline from each active spool package is directed under its respective single thread idler 6, mounted below the active spool and below the drive rolls 7, and then to its respective multiple thread idler on the ganged idler assembly 4. With reference to FIG. 2 each multiple thread idler accommodates its threadline in a different thread position 8–15 so that the multiple thread lines are running parallel to one another at a constant spacing.

Figure 4:
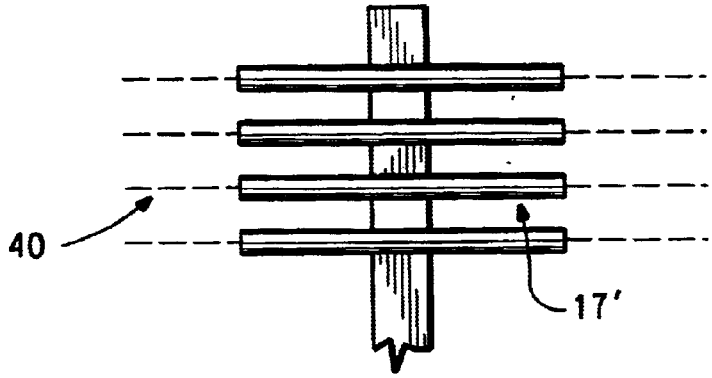
FIG. 4 is a close-up image of the tie tube assembly on an unwinder and splicing device designed to accommodate four active threadlines.
Figure 5:
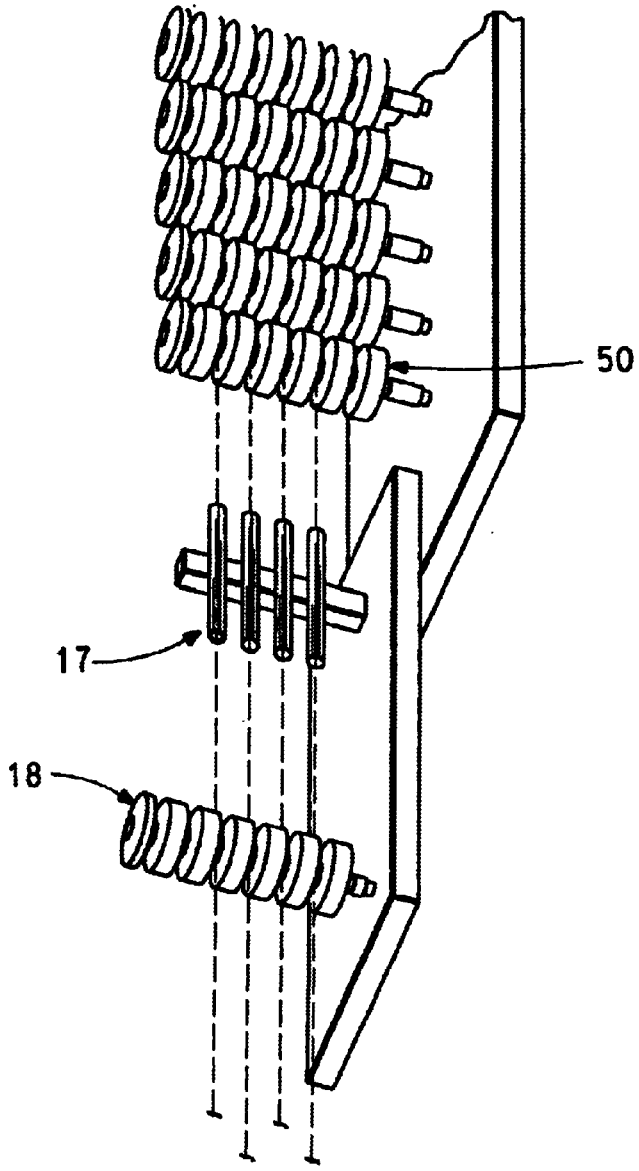
FIG. 5 is an image showing a partial view of the unwinder and splicing device of FIG. 4.

With reference to FIG. 2, a series of discrete length tie-tubes 17 are aligned with each active threadline and are located just after the multiple thread idler assembly 4 downstream of the end spool position, and just before the exit idler 18. Referring to FIGS. 4 and 5, each active thread runs through its respective tie tube 17. Each tie-tube has a slot running the length of the tube, and the tube is oriented so that the slot faces up. The tube slot is wide enough for placing the thread in the tube at set up.

With reference to FIG. 1, when an active thread spool 1 is nearly exhausted, the standby thread 19 is led from its standby spool 2, downwards and around its single thread idler 20, and then upwards to the multiple thread idler corresponding to the standby spool 2. The standby thread is placed in the thread position (FIG. 2, one of positions 8–15) of this idler that corresponds to the threadline about to be replaced. With reference to FIG. 4, the standby thread is then placed through the slit in the tie tube 17' that contains the running, active thread about to be replaced. The standby thread is then positioned in the tie-tube such that the leading end and a small excess length protrude from the downstream end of the tube. This extra length exiting the tube is then wrapped around the tube and the leading end led through the wrap to form an over-hand knot 22 with a short tail. The standby thread tail can then be placed in a holding device until ready to initiate the splice. A small notch in the down stream end of the tie tube can be optionally provided in order to minimize slippage of the standby thread along the downstream end of the tie tube as the knot is being tied. To initiate the splice, the knot is manually pulled forward and off of the tube and the transfer tail is released. The new and running thread will entangle and form the splice.

The dimensions of the tie-tubes are chosen based on several considerations. The diameter should be small enough so as to result in a small diameter wrap and knot. Additionally the diameter must be small enough to accommodate the spacing between threadlines, which is typically about 15 mm. Ideally, a spacing is chosen that allows an operator with large hands to set up and complete a splice. However, the diameter must not be so small as to cause excessive contact between the running and standby threads prior to initiation of the splicing operation. Thin walled tubes with inner diameters of about 0.23 cm to about 0.32 cm and outer diameters of about 0.43 cm to about 0.57 cm are preferred. The tie-tube lengths should be long enough to prevent interference between the running threads and the operator's fingers when completing the wrap and knot, and to minimize the vibration and air currents caused by the moving threads. Tie-tube lengths should not be so long as to increase the likelihood of contact between, and entanglement of, the active and standby threads prior to initiation of the splicing operation. Lengths of about 5 to about 15 cm are preferred. The apparatus is configured such that the tie-tubes are positioned at approximately waist level making it comfortable and ergonomically efficient for the operator to set up and complete the splices.

The standby spool must be maintained in a non-rotating position above the active spool drive rolls until the splicing operation is to be initiated. The apparatus described herein, with reference to FIGS. 1 and 3 provides a means for effecting a reproducible lowering of the standby spool to contact the rotating drive rolls 7, and a reproducible elevation of the exhausted spool so that it can assume the rest position of a replacement standby spool. A controlled vertical displacement, in either direction, of a selected spool can be achieved by use of a pneumatic lift cylinder 23 and appropriate spool cradle 24. The cylinder stroke either lowers the cradle of the standby spool so it comes in contact with the turning drive rolls 7 or lifts the cradle of the exhausted active spool above the drive rolls so that it ceases to rotate. The operation of the cylinder is effected by some suitable means, such as an electric pneumatic valve circuit activated by a foot switch. The use of a foot switch can aid in the control of the cylinder making it easy to both slip the knot and lower the standby roll simultaneously when a splice is initiated.

The cylinder and cradle assembly is mounted so that it can be moved from one spool position to another. One suitable means of achieving this adjustable positioning is to mount the cylinder and cradle assembly on a slide 25 so that the assembly can be moved by a device such as a ball screw assembly operated by a handwheel 26. The ball screw assembly holds the lift cylinder and cradle assembly in a fixed position and has an indicator for accurate positioning of the assembly.

Using the apparatus herein disclosed, the method by which a threadline splice is made, when an active thread spool is nearly exhausted, involves the following steps: a) adjusting the ball screw assembly with the hand wheel 26 to position the pneumatic lift cylinder 23 and spool cradle 24 under the standby spool which is in its rest, non-rotating position above the drive rolls; b) directing the leading end of the thread from the standby spool 2 around the single thread idler 20 that corresponds to the standby spool; c) subsequently directing the leading end of the standby thread to the multiple thread idler 21 that corresponds to the standby spool; d) placing the standby thread in the thread position, (one of positions 8–15 shown in FIG. 3) of this idler corresponding to the threadline that is about to be replaced; e) placing the standby thread through the slit in the tie tube 17', through which the active threadline to be replaced is running so that the leading end and a small excess length of standby thread protrudes past the downstream end of the tie tube; f) wrapping this excess length once around its tie tube; and g) bringing the leading end of the standby thread through the wrap so as to form an overhand knot 22 with a short tail; h) initiating the splice by manually pulling the knot forward and off the downstream end of the tie tube, while simultaneously; i) activating the foot switch, causing the pneumatic lift cylinder 23 to lower the standby spool cradle 24 so that the standby thread spool 2 comes in contact with the drive rolls 7 and begins to rotate so that the now active spool 1 is feeding thread at the rate required; j) manually breaking or cutting the replaced threadline; k) adjusting the ball screw hand wheel assembly 26 to position the lift cylinder and spool cradle under the exhausted spool; l) activating the lift cylinder to raise the exhausted spool to its rest, non-rotating position; and m) replacing the nearly empty spool with a fresh one, which now becomes the standby spool.

FIGS. 4 and 5 show detailed images of the splicer of the invention. Referring to FIG. 4, the active (running) thread 40 passes through the slotted cylindrical tie tube 17'. The replacement threadline 42 containing overhead knot 22 is held apart from the active thread 40. FIG. 5 shows tie tubes 17, exit idler 18 and multiple thread idlers 50.

The apparatus and method of the present invention provide a convenient and effective way for forming splices from a running threadline to a standby threadline without interrupting the manufacturing process. The invention is found to be particularly useful for extensible fibers, such as spandex, since the integrity of the splice can be readily maintained even at high threadline elongations.

What is claimed is:

1. A method for splicing an elastic thread comprising the steps of:

a. feeding a first elastic thread in a line or path between two guides under tension;

b. positioning a second replacement elastic thread substantially parallel to said first thread;

c. slip-knotting said second replacement elastic thread to encircle said first elastic thread with a loop of said second elastic thread without gripping said first elastic thread;

d. tightening the loop of step (c) in said second replacement elastic thread to grip said first elastic thread and to draw said replacement elastic thread along the path of said first elastic thread;

e. releasing tension on said first elastic thread by cutting so that the second elastic thread runs between the thread guides of step (a).

2. The method of claim 1 further comprising the steps of:

f. positioning a third replacement elastic thread substantially parallel to said second elastic thread of step (d);

g. slip-knotting said third replacement elastic thread to encircle said second replacement elastic thread without gripping said second replacement elastic thread;

h. tightening the loop of step (g) in said third replacement elastic thread to grip said second replacement elastic thread and to draw said third replacement elastic thread along the path of said second replacement elastic thread;

i. releasing tension on said second replacement elastic thread by cutting so that the third replacement elastic thread runs between the thread guides of step (a).

3. A splicer comprising:

a. a pair of thread guides for positioning a running thread under tension;

b. a third thread guide for holding at least a portion of a replacement thread substantially parallel to said running thread;

c. a longitudinally slotted cylindrical thread holder for positioning a slip-knotted loop of said replacement thread around said running thread such that said slip-knotted loop and said running thread are initially held apart, such that when the slip-knotted loop is slipped off of the slotted cylindrical thread holder, said replacement thread is drawn through said slotted cylindrical thread holder along the path defined by the running thread.

4. The splicer of claim 3 further comprising means for cutting said running thread.

* * * * *